US012064680B2

(12) United States Patent
Decker

(10) Patent No.: US 12,064,680 B2
(45) Date of Patent: Aug. 20, 2024

(54) GOLF GLOVE WITH GRIP ASSIST STRAP AND METHOD FOR USING

(71) Applicant: Meghan Decker, Carlsbad, CA (US)

(72) Inventor: Meghan Decker, Carlsbad, CA (US)

( * ) Notice: Subject to any disclaimer, the term of this patent is extended or adjusted under 35 U.S.C. 154(b) by 0 days.

(21) Appl. No.: 17/582,442

(22) Filed: Jan. 24, 2022

(65) Prior Publication Data

US 2023/0233924 A1 Jul. 27, 2023

(51) Int. Cl.
*A63B 71/14* (2006.01)
*A41D 19/00* (2006.01)

(52) U.S. Cl.
CPC ..... *A63B 71/146* (2013.01); *A41D 19/0037* (2013.01); *A63B 2209/10* (2013.01)

(58) Field of Classification Search
CPC ..... A41D 19/0037; A41D 19/01552; A41D 19/01582; A41D 19/0044; A41D 19/01547; A63B 71/146; A63B 2209/10; A63B 69/3608
USPC ..... 2/161.4, 161.2
See application file for complete search history.

(56) References Cited

U.S. PATENT DOCUMENTS 2,852,779 A * 9/1958 Roessler ..... A63B 71/146 2/161.1
3,105,972 A * 10/1963 Christopher ..... A63B 71/146 446/901
3,348,238 A * 10/1967 Hydock ..... A63B 71/146 2/161.2
5,088,122 A * 2/1992 O'Toole ..... A63B 71/146 2/161.4
5,414,868 A * 5/1995 Crawford ..... A63B 71/146 2/160
5,742,941 A * 4/1998 Porter ..... A63B 71/146 2/161.4
5,742,942 A * 4/1998 Sykes ..... A63B 71/146 2/161.4
5,845,374 A * 12/1998 Briggs ..... A63B 69/0059 24/442
6,035,442 A * 3/2000 Marando ..... A63B 71/146 2/161.1
6,393,615 B1 * 5/2002 Bedell ..... A41D 19/01547 2/161.1
2009/0222972 A1 * 9/2009 Joung ..... A63B 71/146 2/161.3

FOREIGN PATENT DOCUMENTS

JP 06079029 A * 3/1994
KR 101257635 B1 * 4/2013

* cited by examiner

*Primary Examiner* — Amy Vanatta
(74) *Attorney, Agent, or Firm* — John R. Ross; John R. Ross, III

(57) ABSTRACT

A golf glove with a grip assist device. The golf glove has a glove fastening device for tightening the glove around the hand of the user inserted into the glove. An elastic strap is permanently connected to the golf glove adjacent to the glove fastening device. The elastic strap is wrapped around the user's hand and a golf club that is held in the user's hand and is for assisting the user in gripping the golf club. An elastic strap fastening device is connected to the elastic strap and operates to hold the elastic strap in position while the strap is wrapped around the user's hand and the golf club.

6 Claims, 7 Drawing Sheets

GOLF GLOVE WITH GRIP ASSIST STRAP AND METHOD FOR USING

The present invention relates to golfing devices, and, in particular, to golf gloves.

BACKGROUND OF THE INVENTION

The origins of the game of golf can be traced back over 500 years ago when the Scottish Parliament in 1457 recorded a ban on the game because it was seriously interfering with archery practice. However, the appeal of the game of golf could not be held back and over the years it spread to England, Ireland, the United States and is now virtually played all over the world.

Most golfers will wear a golf glove while playing. A glove is usually worn on the "lead" hand—the hand at the top of the grip. Right-handed players most often wear a glove on the left hand, and left-handed players most often wear a glove on the right hand.

The key reason to wear a golf glove is grip. A golf glove is tackier than skin, particularly in hot weather, and will help to prevent the club from turning in a player's hand. Gloves also help create more friction between the grip and the gloved hand.

Some golfers have physical limitations that make it difficult to properly grip the golf club, even while using a prior art golf glove. For example, a beginning golfer can have difficulty gripping the club. Or a very young or very old golfer can have problems gripping the club. Or medical conditions such as arthritis or Amyotrophic lateral sclerosis (ALS) can make it difficult to properly grip the club.

What is needed is a golf glove that makes it easier to grip the golf club

SUMMARY OF THE INVENTION

The present invention provides a golf glove with a grip assist device. The golf glove has a glove fastening device for tightening the glove around the hand of the user inserted into the glove. An elastic strap is permanently connected to the golf glove adjacent to the glove fastening device. The elastic strap is wrapped around the user's hand and a golf club that is held in the user's hand and is for assisting the user in gripping the golf club. An elastic strap fastening device is connected to the elastic strap and operates to hold the elastic strap in position while the strap is wrapped around the user's hand and the golf club.

DETAILED DESCRIPTION OF THE PREFERRED EMBODIMENTS

Donning the Golf Glove with Grip Assist Strap

Figure 1:
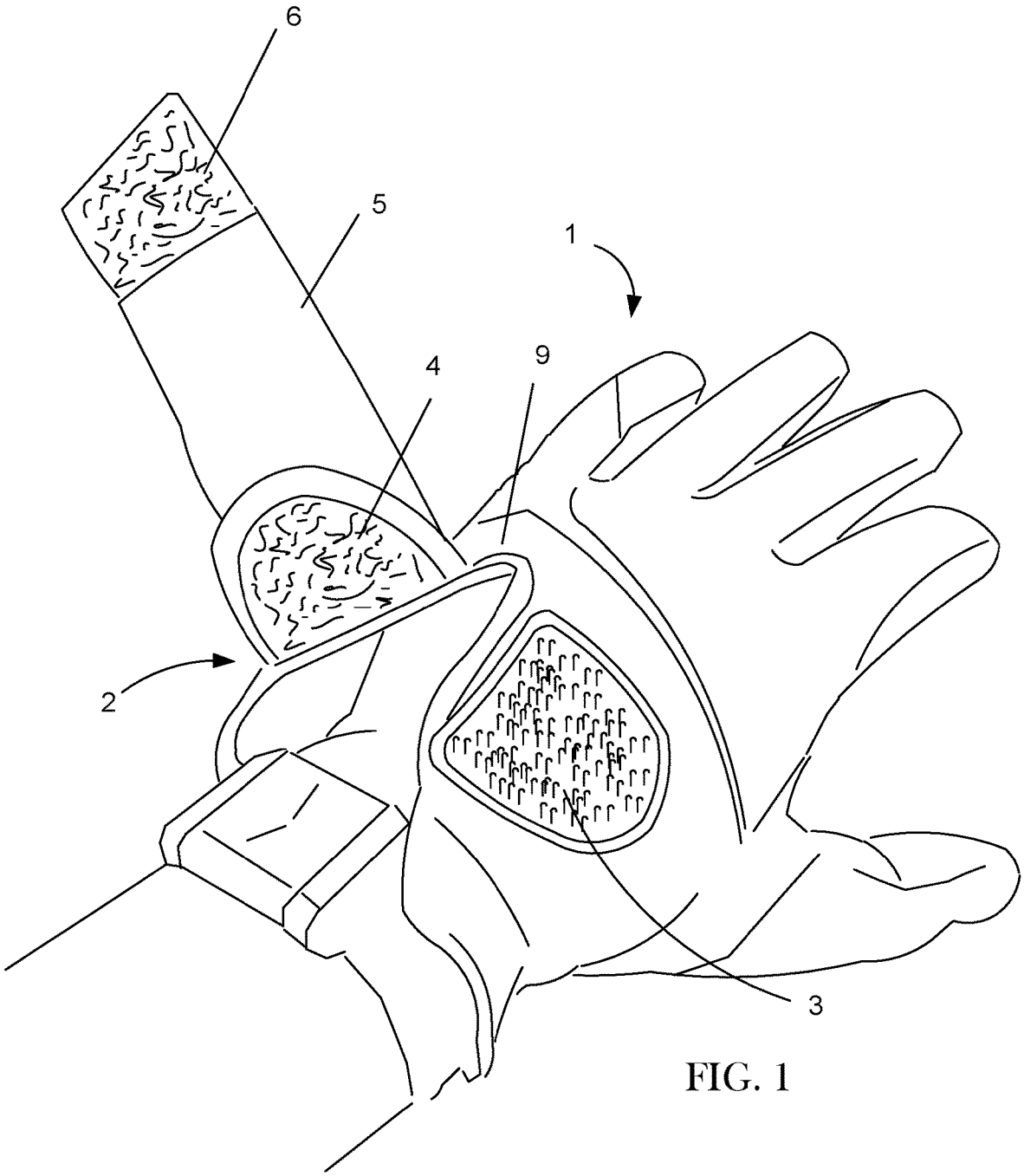
FIG. 1 shows a preferred golf glove after placed on the user's hand.

In FIG. 1, a user has put golf glove 1 onto his left hand. Golf glove 1 includes hook-and-loop fastener 2 having pad section 3 and flap section 4. Pad section 3 is sewn flat onto the back side of glove 1, as shown. One edge of flap section 4 is also sewn onto the back section of glove 1, as shown. Both flap section 3 and pad section 4 are sewn onto opposite sides of glove opening 9. In the embodiment shown in FIG. 1, flap section 4 includes loops and pad section 3 includes hooks.

Figure 2:
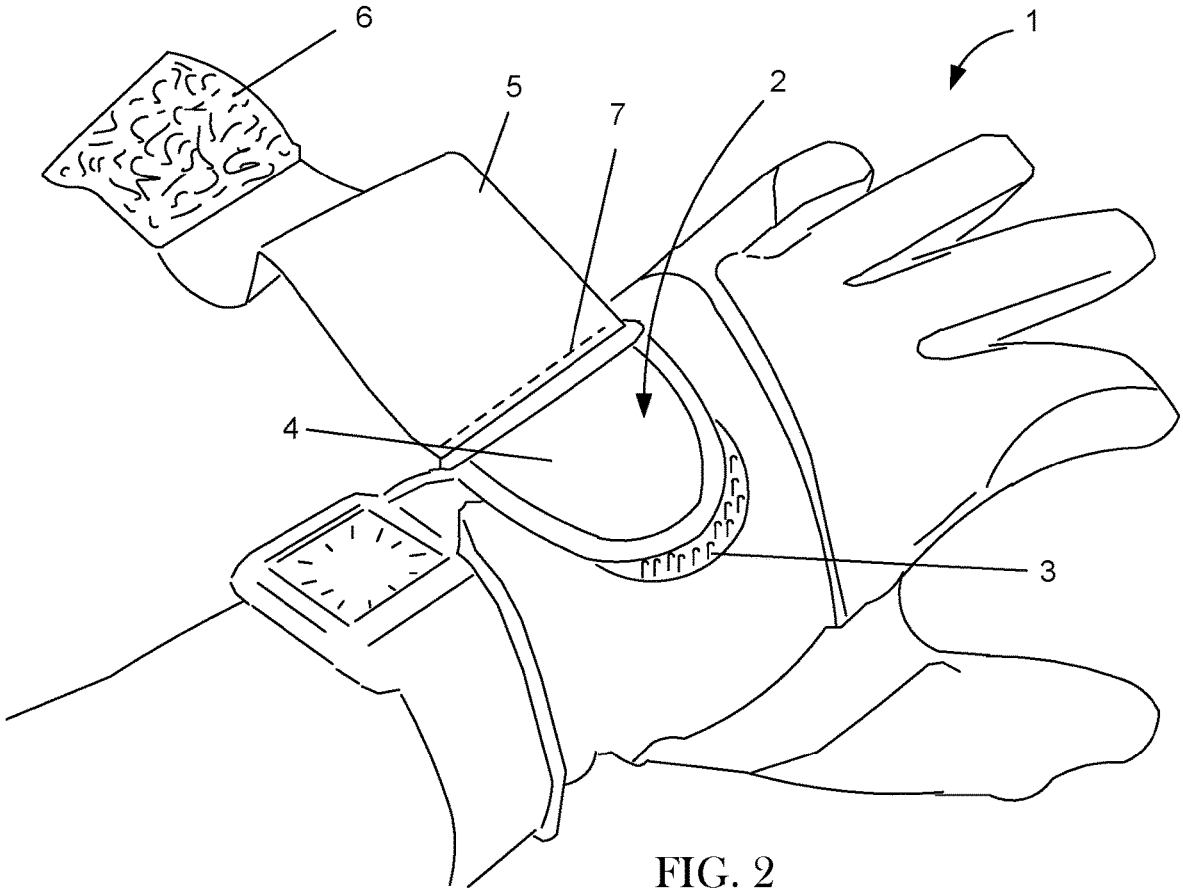
FIG. 2 shows the glove fastening device properly secured.
Figure 3:
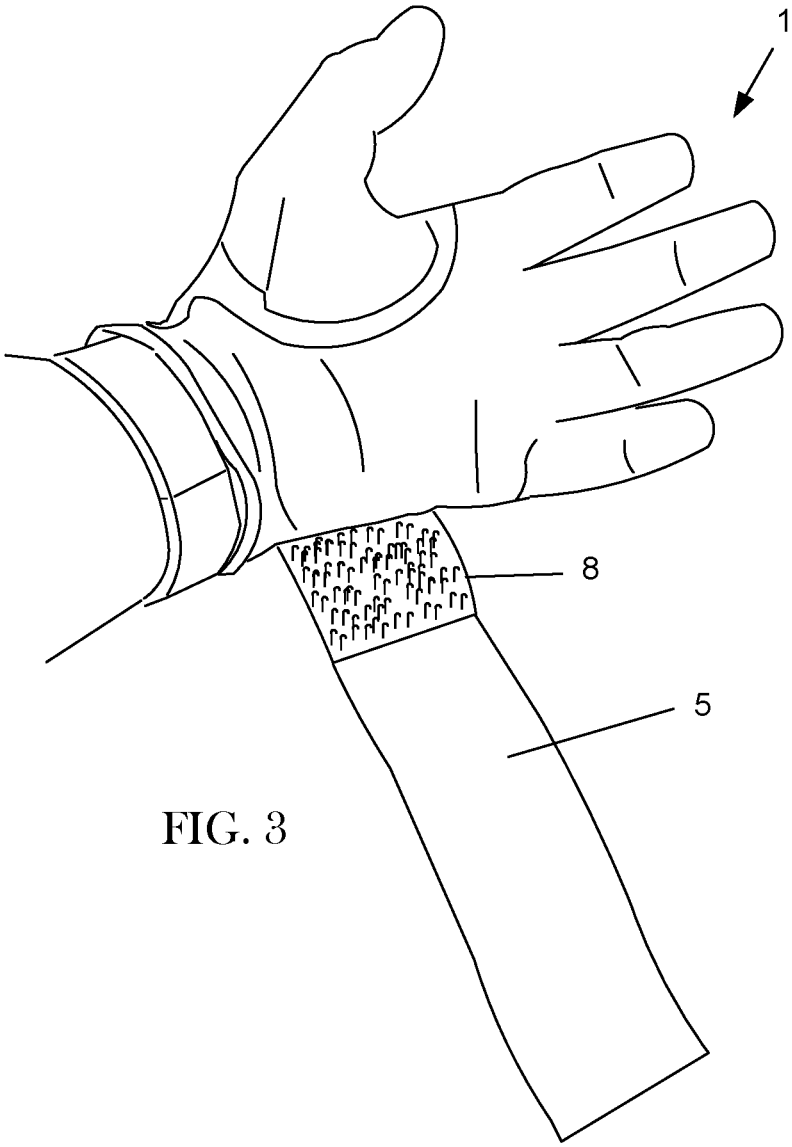
FIG. 3 shows the underside of the golf glove and strap.

In FIGS. 2 and 3, with his right hand the user has pulled flap section 4 towards pad section 3 and has pressed flap section 4 onto pad section 3, thereby closing glove opening 9 and locking sections 3 and 4 together.

As shown in FIGS. 1 and 2, using thread 7 elastic strap 5 is sewn onto glove 1 adjacent to flap section 4. Elastic strap 5 also includes a hook-and-loop fastening device. In the embodiment shown, loop section 6 is sewn onto the distal end of strap 5 and hook section 8 is sewn onto an area of elastic strap 5 close to glove 1 and thread 7 (FIG. 3).

Using the Golf Glove with Grip Assist Strap

To use golf glove 1, the user first places the glove onto his hand, as shown in FIG. 1. In the embodiment shown, golf glove 1 is for the left hand. It should be understood that a similar glove can also be made and utilized for the right hand.

Then the user pulls flap section 4 towards pad section 3 and presses flap section 4 onto pad section 3, thereby closing glove opening 9 and locking sections 3 and 4 together (FIG. 2).

Then the user picks up a golf club and place it into his left hand.

Figure 4:
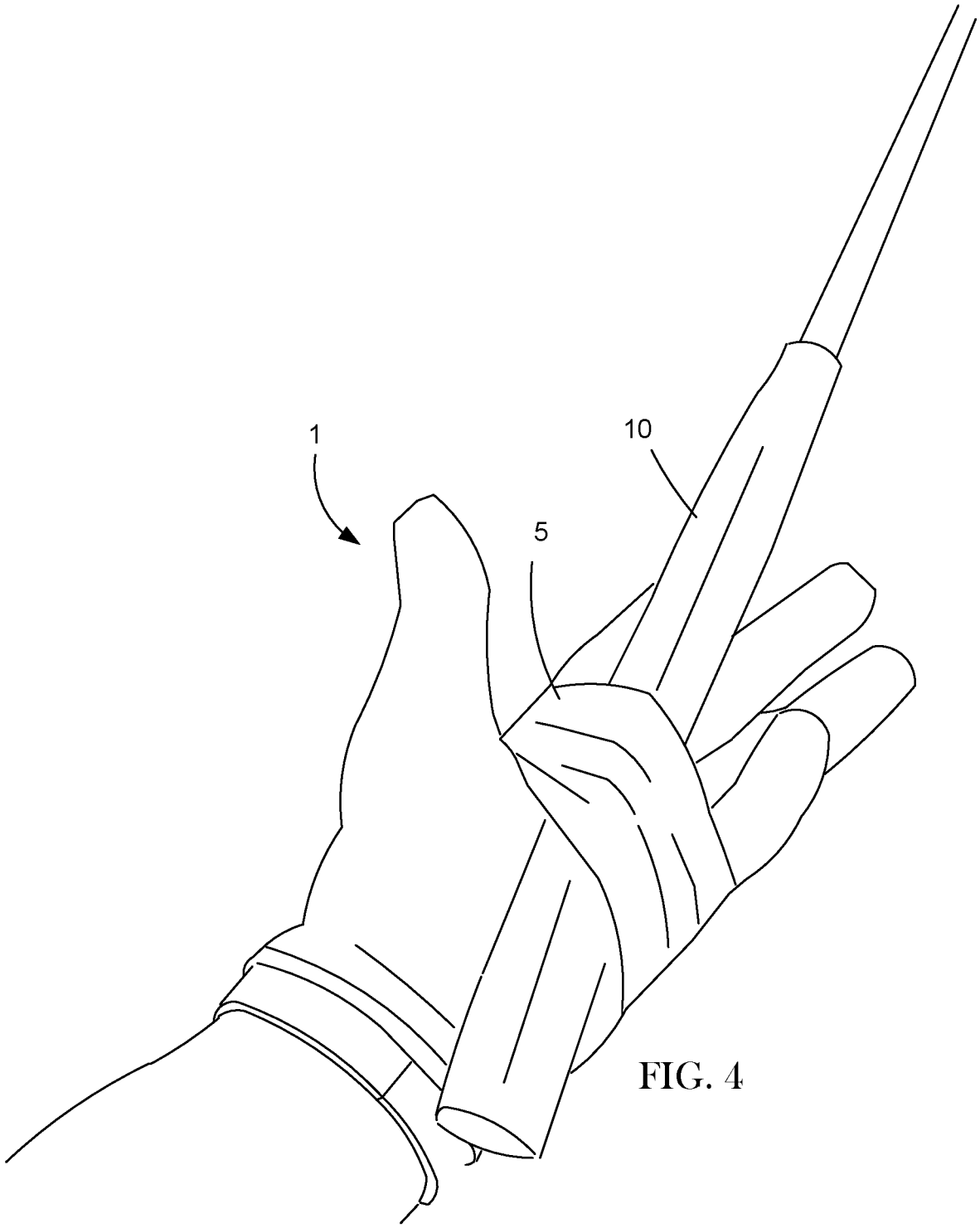
FIG. 4 shows the elastic strap wrapped around the golf club and the user's hand.

Then the user will the pull elastic strap 5 from left to right (FIG. 2), over the top of the back of his left hand and through the area of his hand between the pointer finger and the thumb (FIG. 4). Elastic strap 5 will then be pulled across the palm of the user's hand and over the top of golf club grip 10.

Figure 5:
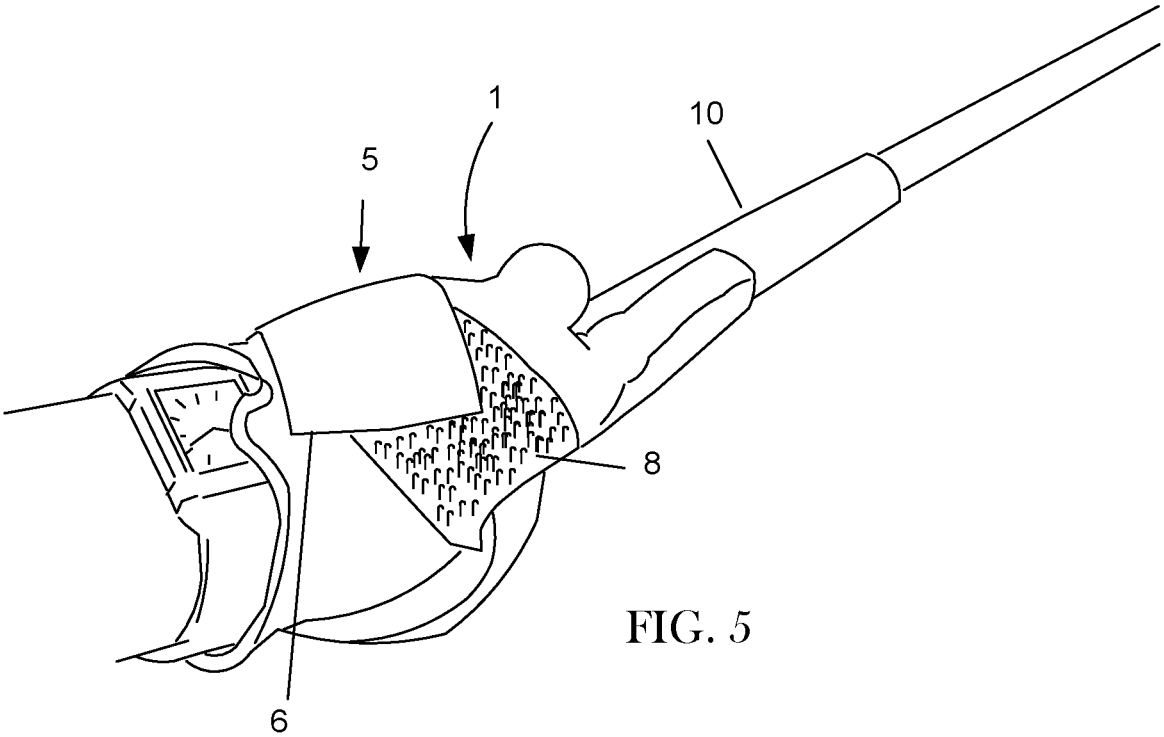
FIG. 5 shows the elastic strap fastening device properly secured.

Elastic strap 5 is then tightly secured around the user's hand and grip 10 as shown in FIGS. 4 and 5. In FIG. 5, loop section 6 is shown engaged with hook section 8 to secure the strap tight around the user's hand and grip. Elastic strap 5 will stay tightly secured until the strap's hook-and-loop fastener is released when no longer needed by the user.

It should be noted that some golfers may also choose to run elastic strap 5 so that it wraps around the thumb as well as the fingers for even stronger grip assistance.

Figure 6:
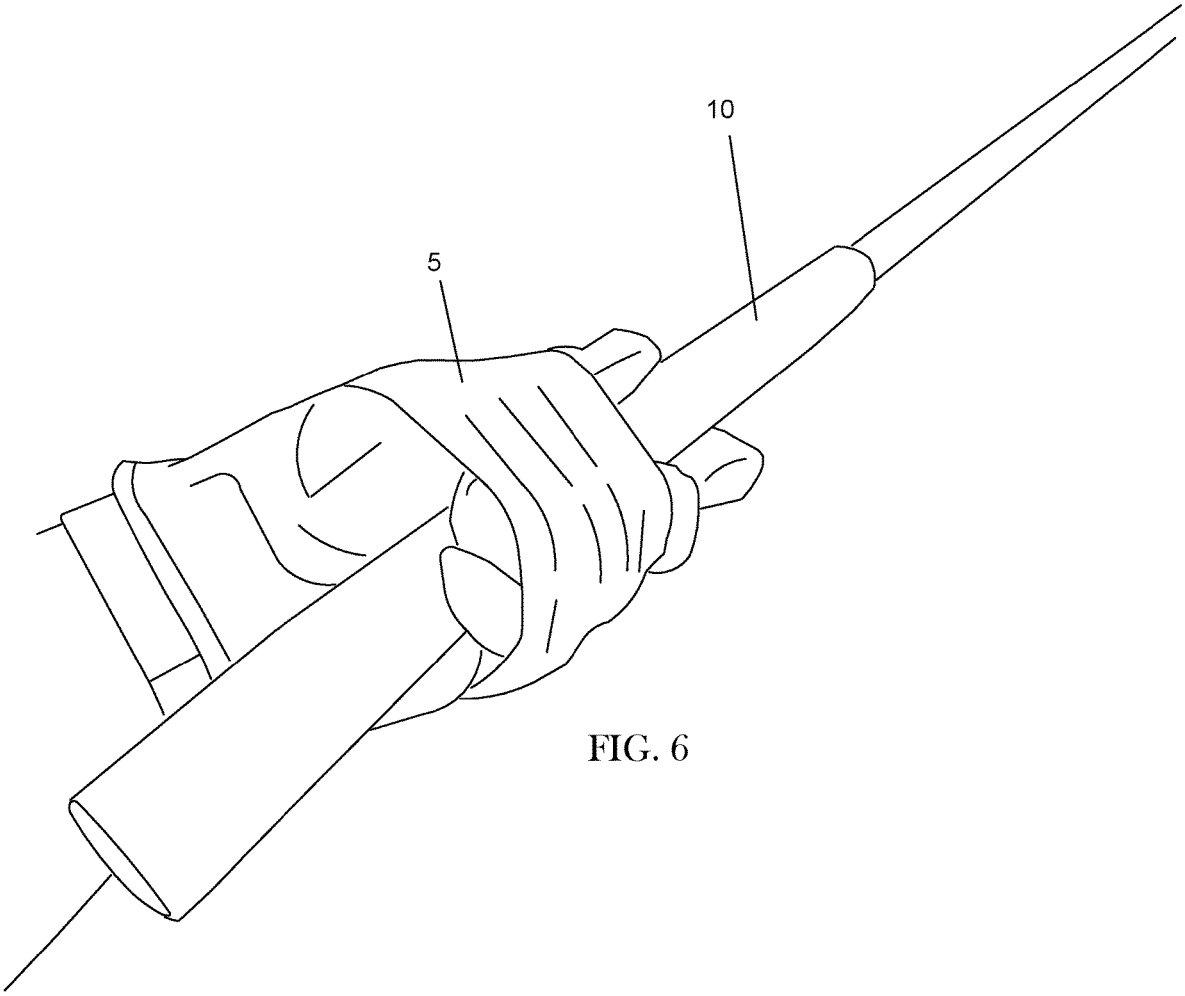
FIG. 6 shows the elastic strap wrapped around the golf club and the user's hand.
Figure 7:
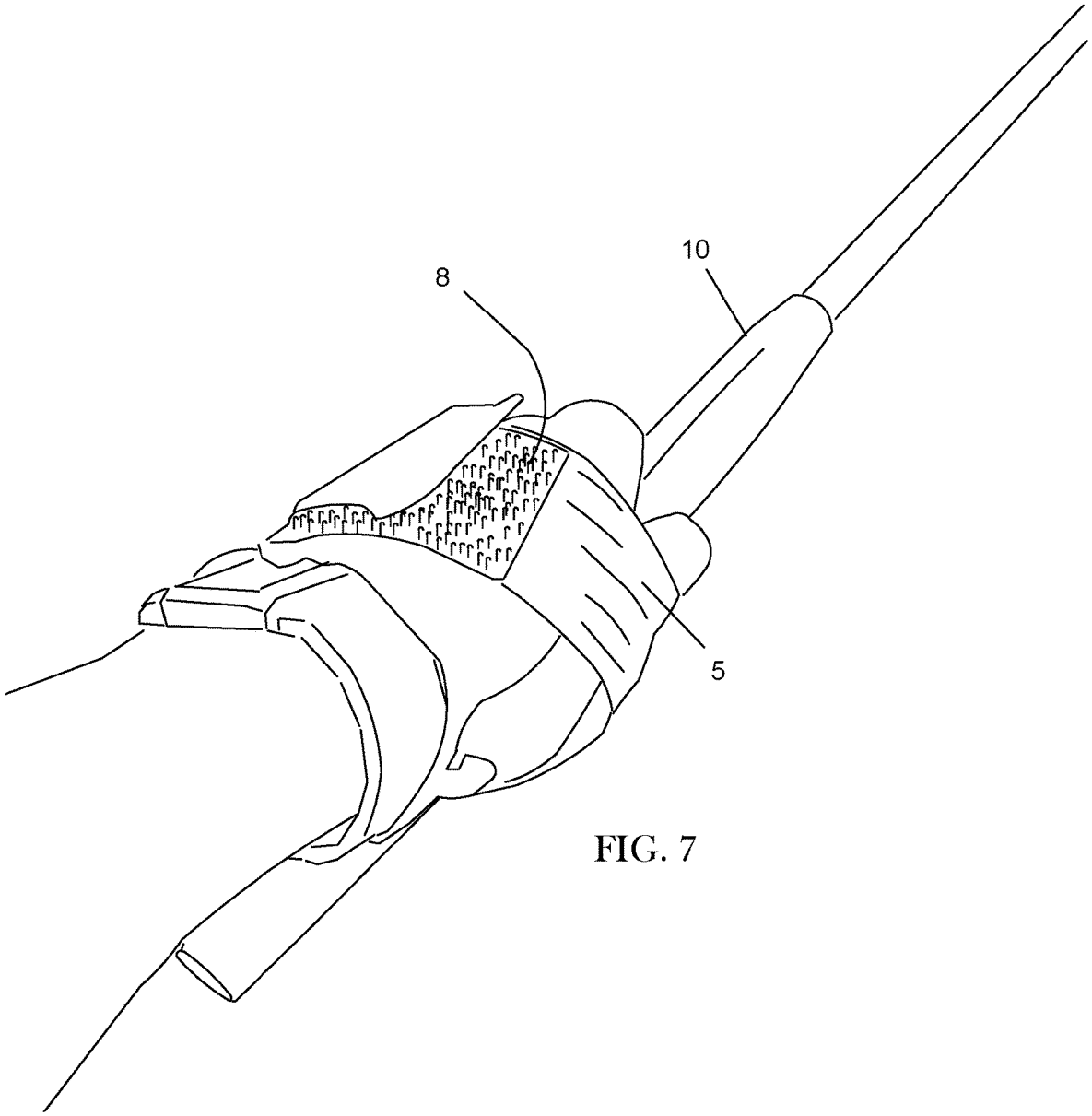
FIG. 7 shows the elastic strap fastening device properly secured.

For example, in FIGS. 6 and 7, the user has pulled elastic strap 5 from left to right (FIG. 2), over the top of the back of his left hand and over the top of his thumb. Elastic strap 5 is then pulled tight across the fingers and back around to hook section 8. The fingers and thumb now are tightly gripping golf club grip 10.

Elastic strap 5 is then tightly secured around the user's hand and grip 10 as shown in FIGS. 4 and 5. In FIG. 7, loop section 6 is shown engaged with hook section 8 to secure the strap tight around the user's thumb, fingers and grip. Elastic strap 5 will stay tightly secured until the strap's hook-and-loop fastener is released when no longer needed by the user.

The invention as described above is very beneficial helping golfers properly grip the golf club. It is recommended for golfers with medical conditions such as ALS or arthritis. It can also be very beneficial for beginning golfers or golfers who are very young or very old.

The above-described invention may also be used by any golfer as a training aid. For example, some very good golfers grip the club too tightly or too loosely. Golf glove 1 will allow a very good golfer to experiment adjusting the tightness of his grip without fear of letting go of the golf club.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A method for using a golf glove with a grip assist device, comprising the steps of:

A) donning said golf glove, said golf glove comprising:

i) a glove fastening device configured to tighten said glove around the hand of a user inserted into said golf glove, ii) an elastic strap permanently connected to said golf glove and adjacent to said glove fastening device, wherein said elastic strap is configured to wrap around the user's hand and a golf club held in the user's hand and is configured to assist the user in gripping said golf club, and iii) an elastic strap fastening device connected to said elastic strap, said elastic strap fastening device configured to hold said elastic strap in position while said elastic strap is wrapped around the user's hand and the golf club held in the user's hand, said elastic strap fastening device comprising:

a) a hook section sewn into one side of said elastic strap, b) a loop section sewn into an opposite side of said elastic strap, B) utilizing said glove fastening device to tighten said glove around the hand, C) running said elastic strap first in a direction towards the thumb, around the user's fingers, then around the golf club and the palm, and then back over the back side of the hand, and D) utilizing said elastic strap fastening device to tighten said elastic strap around the user's hand and the golf club by connecting said hook section to said loop section, both of said elastic strap fastening device.

2. The method as in claim 1, wherein said glove fastening device is a hook-and-loop fastening device.

3. The method as in claim 1, wherein said glove fastening device comprises a pad section sewn onto said glove and a flap section having one sewn edge that is sewn onto said glove.

4. The method as in claim 3, wherein said elastic strap comprises a sewn attachment edge that is sewn onto said glove adjacent to and parallel to said flap section sewn edge.

5. The method as in claim 1, wherein said elastic strap fastening device is a hook-and-loop fastening device.

6. The method as in claim 1, wherein said elastic strap is first run in a direction towards the thumb, around the user's fingers and thumb, around the golf club and the palm, and back over the back side of the hand.

* * * * *